US009677008B2

(12) United States Patent
Whitney et al.

(10) Patent No.: US 9,677,008 B2
(45) Date of Patent: Jun. 13, 2017

(54) HYDROCARBON EMULSION SEPARATOR SYSTEM AND RELATED METHODS

(71) Applicant: HARRIS CORPORATION, Melbourne, FL (US)

(72) Inventors: Ryan Whitney, Indialantic, FL (US); Ronald Jackson, West Melbourne, FL (US); Keith Nugent, Palm Bay, FL (US); Arthur White, Township of Washington, NJ (US); Stephen J. Kolvek, Ridgewood, NJ (US)

(73) Assignee: HARRIS CORPORATION, Melbourne, FL (US)

( * ) Notice: Subject to any disclaimer, the term of this patent is extended or adjusted under 35 U.S.C. 154(b) by 265 days.

(21) Appl. No.: 14/560,079

(22) Filed: Dec. 4, 2014

(65) Prior Publication Data

US 2016/0160132 A1 Jun. 9, 2016

(51) Int. Cl.
*C10G 33/02* (2006.01)
*C10G 33/08* (2006.01)

(52) U.S. Cl.
CPC ..... *C10G 33/02* (2013.01); *C10G 33/08* (2013.01)

(58) Field of Classification Search
CPC ..... C10G 33/00; C10G 33/02; C10G 33/08
See application file for complete search history.

(56) References Cited

U.S. PATENT DOCUMENTS 3,471,396 A 10/1969 Davidse
4,243,506 A 1/1981 Ikeda et al.
4,954,320 A 9/1990 Birmingham et al.
(Continued)

FOREIGN PATENT DOCUMENTS

CA 2 271 439 11/2000
CA 2 680 143 9/2008
(Continued)

OTHER PUBLICATIONS

Conoco Phillips SAGD Overview: http://www.conocophillips.cyclotron.ca/: Retrieved from internet on Nov. 19, 2014; 1 pg.
(Continued)

*Primary Examiner* — Amber R Orlando
*Assistant Examiner* — Britanny Precht
(74) *Attorney, Agent, or Firm* — Allen, Dyer, Doppelt & Gilchrist, P.A.

(57) ABSTRACT

A system for separating a hydrocarbon/water emulsion may include a radio frequency (RF) power source, an RF load, and a coaxial RF emulsion separator. The coaxial RF emulsion separator may include a coaxial input section coupled to the RF power source, a coaxial output section, and a coaxial separator section coupled in series between the coaxial input and output sections. The coaxial separator section may include an inner separator section conductor and an outer separator section conductor surrounding the inner separator section conductor and defining a separating chamber therebetween. The coaxial separator section may have at least one inlet port to introduce the hydrocarbon/water emulsion to the separating chamber and at least one outlet port to remove separated water and hydrocarbon from the separating chamber after exposure to RF power.

26 Claims, 5 Drawing Sheets

(56) References Cited

U.S. PATENT DOCUMENTS

| | | | | |
|---|---|---|---|---|
| 5,884,139 | A | 3/1999 | Roussy et al. | |
| 5,914,014 | A | 6/1999 | Kartchner | |
| 6,077,400 | A | 6/2000 | Kartchner | |
| 6,086,830 | A | 7/2000 | Kartchner | |
| 6,214,175 | B1 | 4/2001 | Heinemann et al. | |
| 7,486,248 | B2 | 2/2009 | Halek et al. | |
| 7,518,092 | B2 | 4/2009 | Purta et al. | |
| 7,714,258 | B2 | 5/2010 | Dalton | |
| 7,889,146 | B2 | 2/2011 | Halek et al. | |
| 7,914,688 | B2 | 3/2011 | Anderson et al. | |
| 8,128,786 | B2 | 3/2012 | White et al. | |
| 8,128,788 | B2 | 3/2012 | Proudkii et al. | |
| 8,168,126 | B2 | 5/2012 | Cha | |
| 8,168,129 | B2 | 5/2012 | Vangeneugden et al. | |
| 8,236,144 | B2 | 8/2012 | Proudkii et al. | |
| 8,337,709 | B2 | 12/2012 | Foret | |
| 8,771,481 | B2 * | 7/2014 | Parsche | H05B 6/52 196/121 |
| 8,840,780 | B2 * | 9/2014 | Parsche | A23L 3/01 196/155 |
| 8,858,785 | B2 * | 10/2014 | Parsche | H05B 6/52 196/112 |
| 8,888,995 | B2 * | 11/2014 | Hernandez | C10B 19/00 204/157.15 |
| 9,441,472 | B2 | 9/2016 | Wright | |
| 2003/0101936 | A1 | 6/2003 | Lee | |
| 2006/0073084 | A1 | 4/2006 | Burkitbayev | |
| 2010/0063271 | A1 * | 3/2010 | Allan | B01J 3/008 536/124 |
| 2010/0219107 | A1 | 9/2010 | Parsche | |
| 2010/0219182 | A1 | 9/2010 | Parsche | |
| 2010/0219184 | A1 | 9/2010 | Parsche | |
| 2010/0230270 | A1 | 9/2010 | Lee et al. | |
| 2011/0294223 | A1 | 12/2011 | Safinya et al. | |
| 2012/0091033 | A1 | 4/2012 | Proudkii et al. | |
| 2012/0108879 | A1 | 5/2012 | Cha et al. | |
| 2012/0247945 | A1 | 10/2012 | Parsche | |
| 2013/0037262 | A1 | 2/2013 | Parsche | |
| 2013/0041199 | A1 | 2/2013 | Hernandez et al. | |
| 2013/0120077 | A1 | 5/2013 | Hernandez et al. | |
| 2013/0180885 | A1 | 7/2013 | Parsche | |
| 2013/0180889 | A1 * | 7/2013 | Parsche | H05B 6/52 208/390 |
| 2013/0180890 | A1 * | 7/2013 | Parsche | H05B 6/52 208/390 |
| 2013/0180980 | A1 * | 7/2013 | Parsche | H05B 6/36 219/672 |
| 2013/0183417 | A1 * | 7/2013 | Parsche | A23L 3/005 426/241 |
| 2013/0213795 | A1 | 8/2013 | Strohm et al. | |
| 2014/0014316 | A1 | 1/2014 | Blue | |
| 2014/0014325 | A1 | 1/2014 | Blue | |
| 2014/0014494 | A1 | 1/2014 | Blue | |

FOREIGN PATENT DOCUMENTS

| | | |
|---|---|---|
| EP | 1 050 330 | 11/2000 |
| WO | 01/12289 | 2/2001 |
| WO | 2008/107696 | 9/2008 |
| WO | 2011/048349 | 4/2011 |

OTHER PUBLICATIONS

Nalco SAGD Central Processing Facility http://www.nalco.com/static/flash_htm/SAGD/SAGD.html: Retrieved from internet on Nov. 19, 2014; 1 pg.

* cited by examiner

HYDROCARBON EMULSION SEPARATOR SYSTEM AND RELATED METHODS

FIELD OF THE INVENTION

The present invention relates to the field of hydrocarbon resource recovery, and, more particularly, to hydrocarbon resource recovery using radio frequency (RF) treatment fixtures.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

With heavy oil recovery methods such as SAGD that utilize steam to heat the reservoir and lower oil viscosity, when the produced fluid comes back to the surface it includes water in oil emulsions that may be difficult and expensive to separate. Also, for the water recovered from the produced fluids to be reused in the steam generation facility, it should include relatively few contaminants (e.g., oil).

Generally speaking, typical methods to separate oil from water rely on a combination of high temperatures, chemical treatment, gravity separation, and/or filtration. However, such configurations may not provide desired performance in some applications, may be limited in their ability to scale for field applications, and considerably increase treatment costs for example.

Another approach for treating hydrocarbons is set forth in U.S. Pat. Pub. No. 2014/0014494 to Blue et al., which is assigned to the present Applicant and is hereby incorporated herein in its entirety by reference. This approach is directed to a radio frequency (RF) hydrocarbon resource upgrading apparatus that includes a first hydrocarbon resource upgrading path that includes a plurality of first RF power applicator stages coupled in series. Each first RF power stage is configured to apply RF power to upgrade a hydrocarbon resource passing therethrough. The apparatus also includes a second hydrocarbon resource upgrading path that includes at least one second RF power applicator stage coupled in parallel with at least one of the first RF power applicator stages. The second RF power applicator stage is configured to apply RF power to upgrade a hydrocarbon resource passing therethrough. Accordingly, the RF hydrocarbon resource upgrading apparatus upgrades the hydrocarbon resource passing through multiple hydrocarbon resource upgrading paths. This may be particularly advantageous for efficiently upgrading the hydrocarbon resource according to different operating parameters to output one or more upgraded hydrocarbon resource products with different desired characteristics, for example.

Despite the existence of such configurations, further enhancements for emulsion treatment and water/hydrocarbon fluid separation may be desirable in some instances.

SUMMARY OF THE INVENTION

A system for separating a hydrocarbon/water emulsion may include a radio frequency (RF) power source, an RF load, and a coaxial RF emulsion separator. The coaxial RF emulsion separator may include a coaxial input section coupled to the RF power source and including an inner input section conductor and an cuter input section conductor surrounding the inner input section conductor, a coaxial output section comprising an inner output section conductor and an outer output section conductor surrounding the inner output section conductor, and a coaxial separator section coupled in series between the coaxial input and output sections. The coaxial separator section may include an inner separator section conductor and an outer separator section conductor surrounding the inner separator section conductor and defining a separating chamber therebetween. The coaxial separator section may have at least one inlet port to introduce the hydrocarbon/water emulsion to the separating chamber and at least one outlet port to remove separated water and hydrocarbon from the separating chamber after exposure to RF power.

More particularly, the coaxial separator section may include a pair of dielectric spaced end plates interchangeably supporting respective opposing ends of the inner separator conductor and defining opposing ends of the separating chamber. The input coaxial section may have a dielectric material between the inner input section conductor and the outer input section conductor, and the output coaxial section may have the dielectric material between the inner output section conductor and the outer output section conductor. The at least one inlet port may be defined in the outer separator section conductor, and the at least one outlet port may be defined in the outer separator section conductor.

In an example embodiment, at least one sensor may be associated with the coaxial RF emulsion separator. Furthermore, a flow controller may be associated with at least one inlet and outlet port to perform at least one of batch separating and continuous separating. In accordance with an example embodiment, the RF source may include a plurality of RF signal generators having respective different RF signal frequency ranges, and a power combiner coupled to the plurality of RF signal generators. The RF source may be configured to sweep the RF power over a wideband operating frequency range. By way of example, the RF source may operate over a frequency range of 0.5 to 200 MHz. The system may further include an RF load coupled to the coaxial output section, although an open circuit type termination may also be used in some embodiments.

A related coaxial RF separator, such as the one described briefly above, and a related method for separating a hydrocarbon/water emulsion are also provided. The method may include introducing a hydrocarbon/water emulsion into a coaxial separator section of a coaxial RF emulsion separator coupled in series between a coaxial input section and a coaxial output section, with the coaxial separator section comprising an inner separator section conductor and an outer separator section conductor surrounding the inner separator section conductor and defining a separating chamber therebetween, and the coaxial separator section having at least one inlet port to introduce the hydrocarbon/water emulsion to the separating chamber. The method may further include supplying radio frequency (RF) power to the coaxial input section of the coaxial RF emulsion separator, with the coaxial input section comprising an inner input section conductor and an outer input section conductor surrounding the inner input section conductor, and the coaxial output section comprising an inner output section conductor and an outer output section conductor surrounding the inner output section conductor. Separated water and hydrocarbon may be removed from the separating chamber via at least one outlet port of the coaxial separator section after exposure to RF power.

A related coaxial RF hydrocarbon treatment device may include a coaxial input section configured for coupling to an RF power source and including an inner input section conductor and an outer input section conductor surrounding the inner input section conductor, and a coaxial output section configured for coupling to an RF load and including an inner output section conductor and an outer output section conductor surrounding the inner output section conductor. A coaxial treatment section may be coupled in series between the coaxial input and output sections, with the coaxial treatment section including an inner treatment section conductor and an outer treatment section conductor surrounding the inner treatment section conductor and defining a treatment chamber therebetween. The coaxial treatment section may have at least one inlet port to introduce a hydrocarbon to the treatment chamber and at least one outlet port to remove treated hydrocarbon from the treatment chamber after exposure to RF power.

DETAILED DESCRIPTION OF THE EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in different embodiments.

Figure 1:
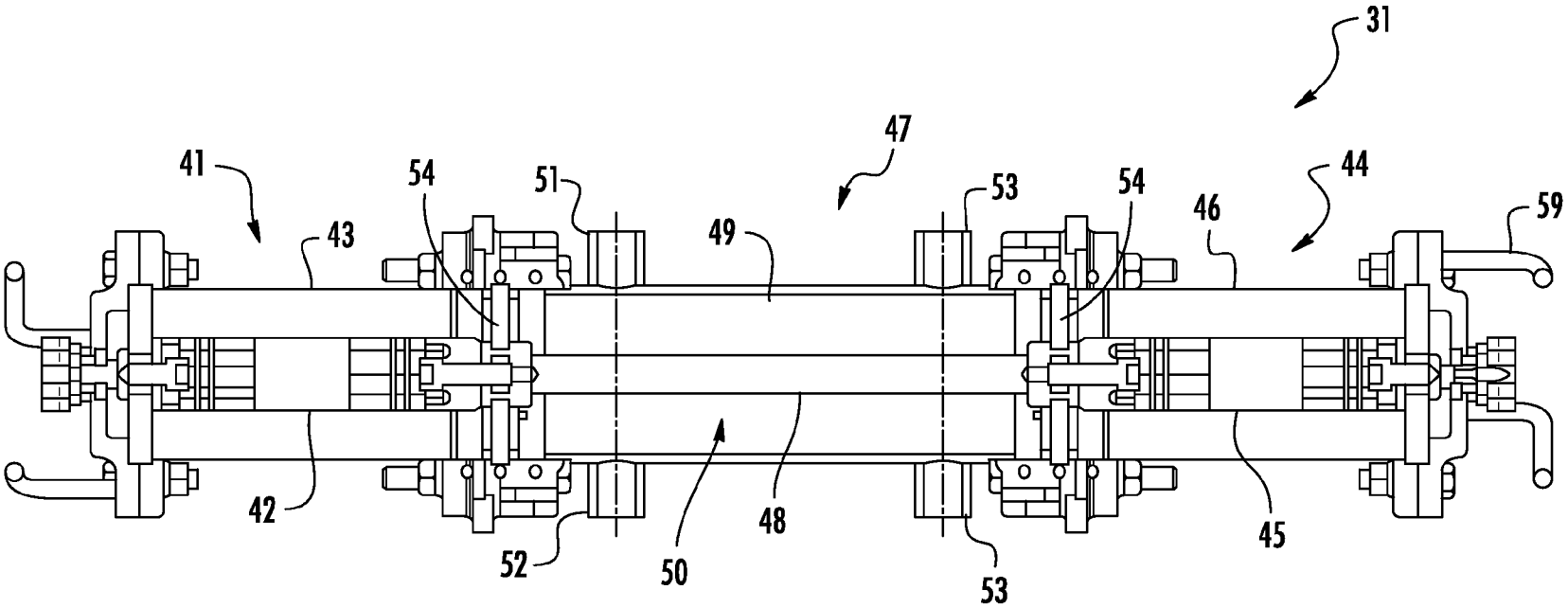
FIG. 1 is a cross-sectional diagram of a coaxial RF emulsion separator in accordance with an example embodiment.
Figure 2:
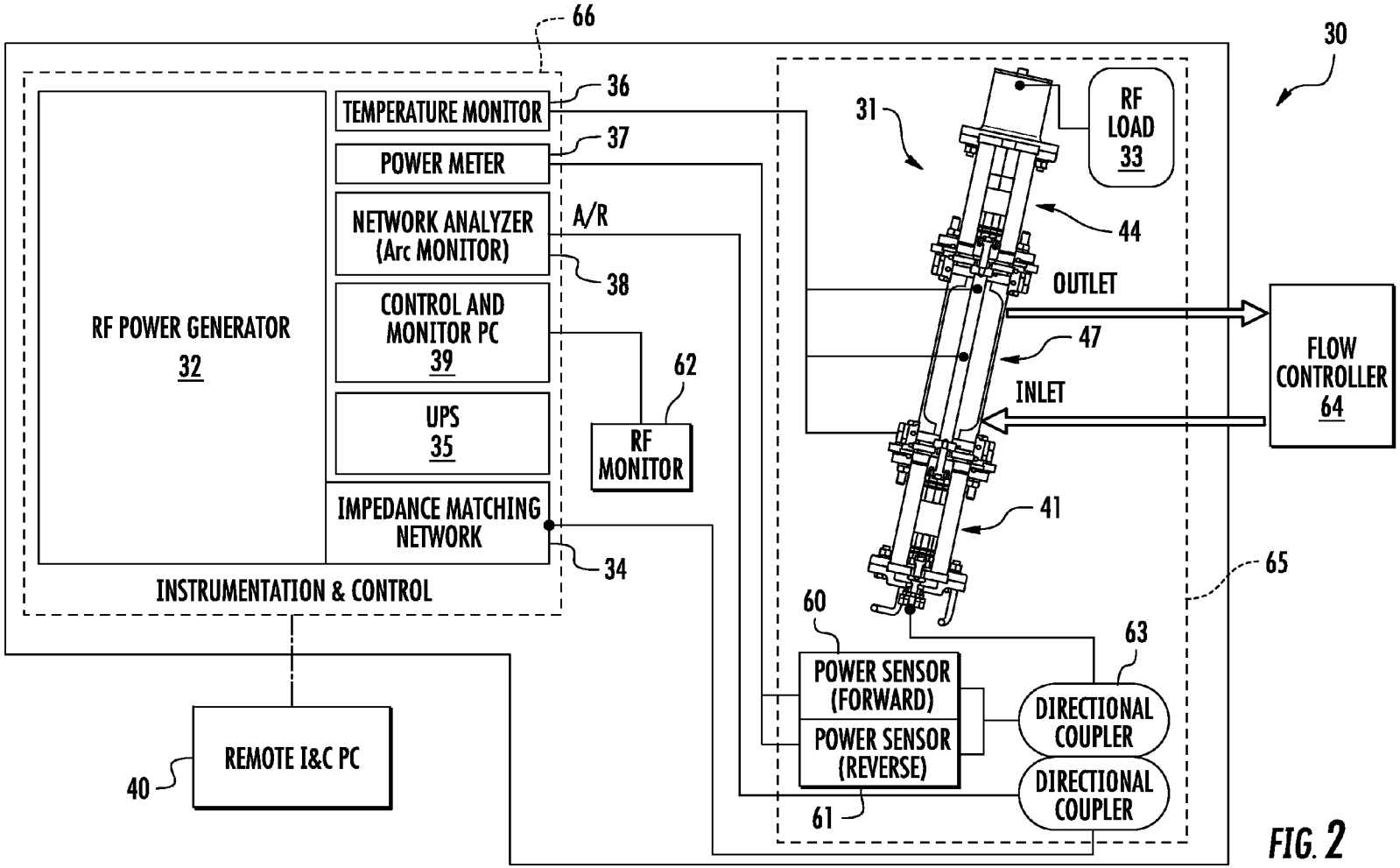
FIG. 2 is a schematic block diagram of a system for separating a hydrocarbon/water emulsion incorporating the coaxial RF separator of FIG. 1.

Referring initially to FIGS. 1 and 2, a system 30 for separating a hydrocarbon/water emulsion incorporating a coaxial RF emulsion separator 31 is first described. The system 30 illustratively includes an RF power source or generator 32, an RF load 33, and the coaxial RF emulsion separator 31. In the illustrated embodiment, the RF power generator 32 may be included within an instrumentation and control assembly 66 (e.g., a rack mount assembly, etc.) which also illustratively includes an impedance matching network 34 to couple the RF power generator to the coaxial RF emulsion separator 31. The instrumentation and control assembly 66 further illustratively includes a universal power supply (UPS) 35, a temperature and/or pressure data acquisition monitor 36 to monitor operating temperatures of the coaxial RF emulsion separator 31, a power meter 37 to monitor RF power supplied to the coaxial RF emulsion separator, a network analyzer 38 for observing impedance changes in the system (and which may also be used for arc detection) to verify desired reactions from the RF exposure, and a computing device 39 (e.g., a CPU (PC, Mac, etc.) and monitor) to provide for monitoring and controlling one or more of the above-noted components. In some embodiments, a remote interface and control computing device 40 (e.g., a PC or Mac) may remotely communicate and cooperate with the computing device 39 in this regard, which may be the case where the system 30 is deployed at a well site, for example.

The coaxial RF emulsion separator 31 illustratively includes a coaxial input section 41 coupled to the RF power generator 32, which includes an inner input section conductor 42 and an outer input section conductor 43 surrounding the inner input section conductor. Furthermore, the coaxial RF emulsion separator 31 also illustratively includes a coaxial output section 44, which in the example of FIG. 2 is connected to the RF load 33. The coaxial output section 44 includes an inner output section conductor 45 and an outer output section conductor 46 surrounding the inner output section conductor. Furthermore, a coaxial separator section 47 is electrically coupled in series between the coaxial input and output sections 41, 44. More particularly, the coaxial separator section 47 includes an inner separator section conductor 48 and an outer separator section conductor 49 surrounding the inner separator section conductor and defining a separating chamber or annulus 50 therebetween.

The coaxial separator section 47 further illustratively includes one or more inlet ports 51 to introduce the hydrocarbon/water emulsion to the separating chamber 50, and one or more outlet ports 52 to remove separated water and hydrocarbon (i.e., the broken emulsion) from the separating chamber after exposure to RF power. One or more additional ports 53 may also be provided for expansion and/or venting, sensors (temperature or pressure for example), or for configuration as additional inlet or outlet ports as desired. In the example embodiment, the ports 51-53 are defined in the outer separator section conductor 49, that is, they pass through the outer separator section conductor and are orthogonal thereto, although other suitable port configurations may be used in different embodiments.

The coaxial separator section 47 also illustratively includes a pair of spaced end plates 54 which may interchangeably support respective opposing ends of the inner separator conductor 48, and define opposing ends of the separating chamber 50. More particularly, the inner separator conductor 48 may be fabricated in a plurality of different diameters, so that a different inner separator conductor may be used to provide a desired annuls width for the separation chamber 50. Generally speaking, different widths of the separation chamber 50 may be desirable based upon the viscosity of the emulsion being treated. That is, while a smaller width or gap provides increased RF field strength, highly viscous emulsions may warrant a wider gap. Moreover, the wider the gap, the greater the volume of emulsion that can be treated at a given time. Yet, since different inner separator conductors 48 may be interchanged with the outer separator conductor 49 as needed for a given implementation, this provides significant flexibility for changing the operational setup with relative ease. Of course, in some embodiments, different diameters of outer separator conductors 49 may also be used to affect the gap width of the separator chamber 50, if desired. The inner separator conductor(s) 48 may be solid or hollow. By way of example, the inner and outer separator conductor 48, 49 may comprise copper, although suitable conductive materials or alloys may also be used, as will be appreciated by those skilled in the art. A length of the separation or bulk heating section is also scalable for each application depending on hydrocarbon/emulsion flow rate vs. desired resonant time in electric field, as will be appreciated by those skilled in the art.

The input coaxial section 41 may have a dielectric material between the inner input section conductor 42 and the outer input section conductor 43, and the output coaxial section 44 may similarly have the dielectric material between the inner output section conductor 45 and the outer output section conductor 46. By way of example, the dielectric material may be an air dielectric, although other inert gases (e.g., nitrogen, etc.) or dielectric fill materials may also be used to provide desired electrical insulation within the input coaxial section 41 and the output coaxial section 44, as will be appreciated by those skilled in the art. Handles 59 may optionally be mounted on the ends of the input coaxial section 41 and the output coaxial section 44 for use in moving and/or assembling the coaxial RF emulsion separator, if desired.

In the example embodiment of FIG. 2, a plurality of sensors are used to monitor the RF power and emulsion separation status. For example, forward and reverse power sensors 60, 61 may be coupled to the power meter 37. Moreover, an RF monitor sensor 62 may be coupled to the computing device 39 to detect potentially harmful levels of radiation to operators. Furthermore, one or more directional couplers 63 are illustratively coupled between the impedance matching network 34 and the input coaxial section 41.

A flow controller 64 may be associated with the inlet and outlet ports 51, 52 to control the flow of emulsion into and out of the separating chamber 50 for processing. The flow controller 64 may be used to perform batch separating, in which a given quantity of emulsion is introduced into the separating chamber 50 and treated for a certain period of time, or to provide continuous separating or treatment in which the emulsion is circulated through the separation chamber in a continuous fashion. By way of example, in a typical application, a desired exposure time for the emulsion in the separating chamber 50 may be from one to fifteen minutes in a batch mode, and from thirty seconds to five minutes in a continuous or flow-through mode, depending on the flow rates and emulsion water content, although other time periods may also be used in different embodiments.

The flow controller 64 may include one or more pumps, valves, and flow measuring devices, as will be appreciated by those skilled in the art. The flow controller 64 may include its own computing control device, or it may be controlled by the computer device 39, for example. In some embodiments, the coaxial RF emulsion separator 31, sensors 60, 61, the directional coupler(s) 63, and the RF load 33 may be positioned within a common housing or fixture 65 at the wellhead or refining facility where emulsion treatment is to take place, which may be co-located with or separated from the instrumentation and control assembly 66, depending upon the given implementation.

Figure 3:
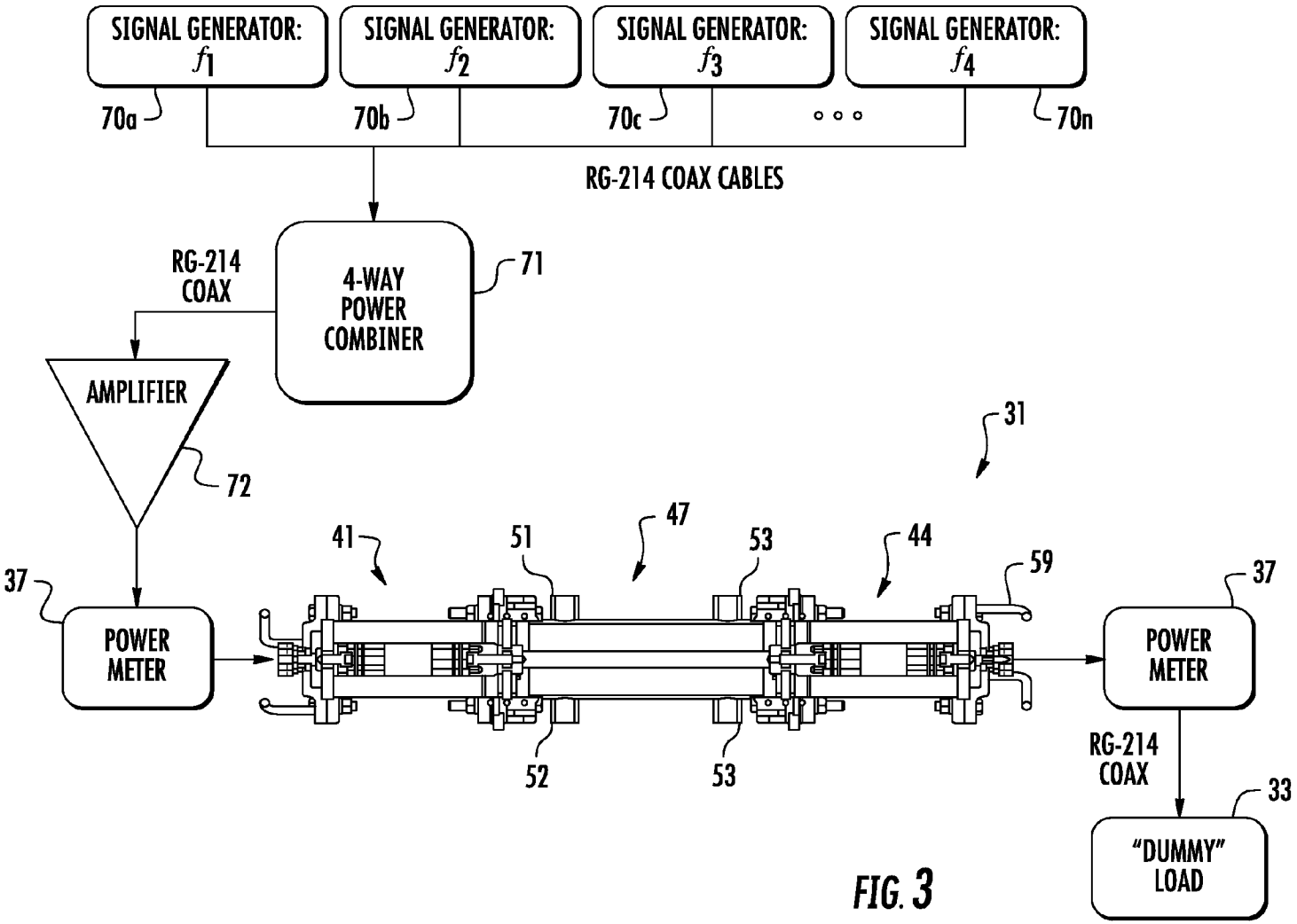
FIG. 3 is a schematic block diagram of the system of FIG. 2 illustrating an example RF source arrangement with a closed circuit configuration for the coaxial RF emulsion separator.

Referring now additionally to FIG. 3, an example configuration of the RF power generator 32 illustratively includes a plurality of RF signal generators 70*a*-70*n* for generating respective different RF signals $f_1$-$f_n$. By combining the different signals covering a relatively wide range of frequencies $f_1$-$f_n$ using a power combiner 71, this advantageously provides for a wideband RF power exposure of the emulsion by the coaxial RF emulsion separator 31. By way of example, the RF source 32 may operate over a frequency range of 0.5 to 200 MHz, although other operating frequencies may be used in different embodiments. Furthermore, in some embodiments, the RF source 32 may be configured to sweep the RF power over the wideband operating frequency range, rather than combining the outputs of the different RF signal generators 70*a*-70*n* as shown.

By way of example, in a batch mode, an example RF power range may be 500-2000 W. In a flow-through mode, an example power range of up to 50 kW may be used, depending on flow rates and emulsion water content. Here again, these are example operating ranges, and other power levels may be used in different embodiments as appropriate. Applicant theorizes, without wishing to be bound thereto, that for exposing typical SAGD process emulsions, a water content separation of up to 95% may be achieved in certain implementations using the coaxial RF emulsion separator 31, depending on the given material properties and parameters applied (e.g., frequency, power, duration, etc.).

An output of the power combiner 71 (which in the illustrated example is a 4-way power combiner, although other numbers of signal generators 70*a*-70*n* may be used in different embodiments) is coupled to an amplifier 72, the output of which is measured by the power meter 37 and supplied to the input coaxial section 41. The various components illustrated in FIG. 3 may be connected using suitable cables, such as RG-214 coaxial cables, for example, although other suitable cables may also be used in different embodiments.

Figure 4:
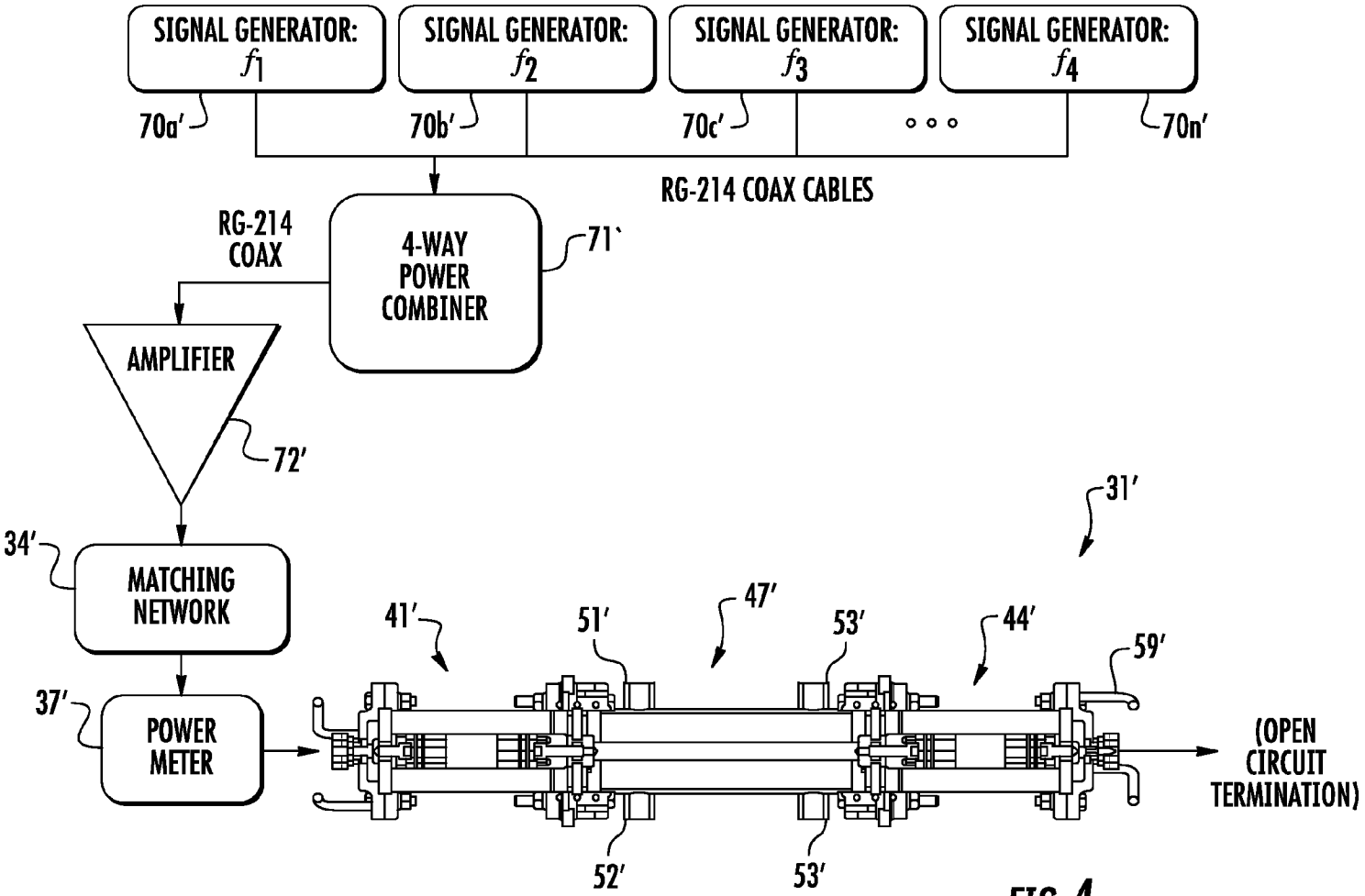
FIG. 4 is a schematic block diagram of the system of FIG. 2 illustrating an example RF source arrangement with an open circuit configuration for the coaxial RF emulsion separator.

Another electrical connection configuration for the coaxial RF emulsion separator 31' is shown in FIG. 4. Here, instead of being connected with the "dummy" RF load 33 as in the configuration of FIG. 3, the output coaxial section 44' instead has an open circuit termination, and the matching network 34' is coupled inline between the amplifier 72', power meter 37', and the input coaxial section 41', as shown.

Figure 5:
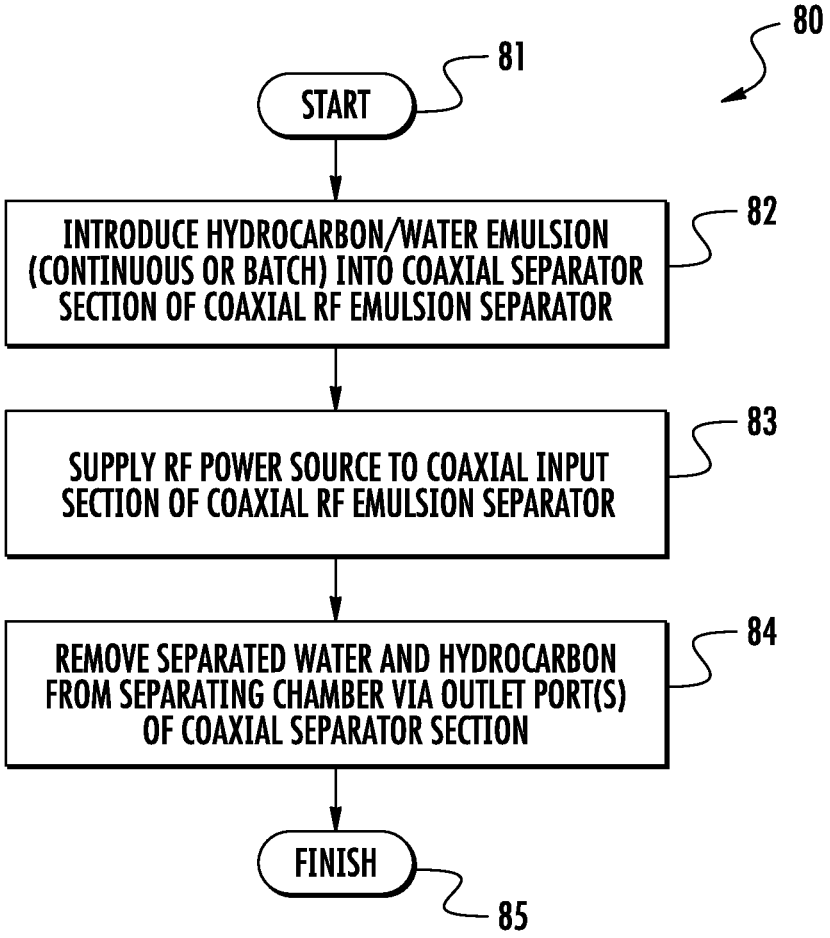
FIG. 5 is a flow diagram illustrating a method for separating a hydrocarbon/water emulsion in accordance with an example embodiment.

A related method for separating a hydrocarbon/water emulsion using the coaxial RF emulsion separator is now described with reference to the flow diagram 80 FIG. 5. Beginning at Block 81, the hydrocarbon/water emulsion may be introduced into the coaxial separator section 47 of the coaxial RF emulsion separator 31 (continuously or in batches), at Block 82. Furthermore, the method may include supplying RF power from the RF power source 32 to the coaxial input section 41 of the coaxial RF emulsion separator 31, at Block 83, so that the hydrocarbon/water emulsion within the separating chamber 50 is exposed to RF power from the RF power source 32, as described further above. The "broken" emulsion, i.e., separated water and hydrocarbon, may be removed from the separating chamber 50 via the outlet port(s) 52 of the coaxial separator section 47 after the exposure to RF power, at Block 84, which illustratively concludes the method of FIG. 5 (Block 85).

One particular advantage of the above-noted configuration is that the coaxial transmission line configuration of the coaxial RF emulsion separator 31 allows it to be placed inline with current hydrocarbon process flows using RF hydrocarbon recovery techniques, such as described in U.S. application Ser. No. 14/167,039 filed Jan. 29, 2014, which is also assigned to the present Applicant and is hereby incorporated herein in its entirety by reference. In this regard, industry standard coaxial transmission line components may be used for construction of the coaxial RF emulsion separator 31, if desired. Moreover, the length of the coaxial separator section 47 may be adjusted to accommodate different flow rates and required exposure times.

The coaxial RF emulsion separator 31 may advantageously be used to not only provide exposure to RF fields for emulsion breaking, but also to provide RF heating through the application of a high power RF signal to the coaxial structure, as will be appreciated by those skilled in the art. This may be advantageous for reducing viscosity of an emulsion or other hydrocarbon source, and in this regard multiple coaxial RF emulsion separators 31 may be incorporated into a process flow for viscosity reduction and/or emulsion breaking, as needed. The coaxial RF emulsion separator(s) 31 may also be connected in the process flow with conventional gravity settling tanks, desalinization tanks, etc. While dilutents are typically introduced into the process flow when such tanks are used, the above-described approach may advantageously help reduce (or eliminate) the use of dilutents required for emulsion breaking, which can provide significant benefits not only in terms of costs (as dilutents can be more expensive than the hydrocarbon material being recovered in some instances), but also in terms of disposal and environmental impact.

It should also be noted that the above-described approach and coaxial RF emulsion separator 31 may be applicable to the treatment of oil/water emulsions in other contexts besides oil and gas recovery. For example, this approach may potentially be used more generally in oil and gas steam facilities, oil spill recovery, etc. Moreover, it will also be appreciated that the coaxial RF emulsion separator 31 may not only be used at wellheads and refineries, for example, but in some instances it could be implemented underground, such as in the flow path of an underground RF transmission line used in an RF heating application (see, e.g., U.S. application Ser. No. 14/167,039 noted above), or underground pipeline. Again, the RF emulsion separator 31 may also be used more generally for treating a hydrocarbon, such as generalized bulk heating for a hydrocarbon stream, whether or not in an emulsion form.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for separating a hydrocarbon/water emulsion comprising:

a radio frequency (RF) power source; and a coaxial RF emulsion separator comprising a coaxial input section coupled to said RF power source and comprising an inner input section conductor and an outer input section conductor surrounding said inner input section conductor, a coaxial output section and comprising an inner output section conductor and an outer output section conductor surrounding said inner output section conductor, and a coaxial separator section coupled in series between said coaxial input and output sections, said coaxial separator section comprising an inner separator section conductor and an outer separator section conductor surrounding said inner separator section conductor and defining a separating chamber therebetween, said coaxial separator section having at least one inlet port to introduce the hydrocarbon/water emulsion to the separating chamber and at least one outlet port to remove separated water and hydrocarbon from the separating chamber after exposure to RF power.

2. The system of claim 1 wherein said coaxial separator section comprises a pair of spaced end plates interchangeably supporting respective opposing ends of said inner separator conductor and defining opposing ends of the separating chamber.

3. The system of claim 1 wherein said input coaxial section comprises a dielectric material between said inner input section conductor and said outer input section conductor; and wherein said output coaxial section comprises the dielectric material between said inner output section conductor and said outer output section conductor.

4. The system of claim 1 wherein the at least one inlet port is defined in said outer separator section conductor; and wherein the at least one outlet port is defined in said outer separator section conductor.

5. The system of claim 1 further comprising an RF load coupled to said coaxial output section of the coaxial RF emulsion separator.

6. The system of claim 1 further comprising at least one sensor associated with said coaxial RF emulsion separator.

7. The system of claim 1 further comprising a flow controller associated with the at least one inlet and outlet port to perform at least one of batch separating and continuous separating.

8. The system of claim 1 wherein said RF source comprises a plurality of RF signal generators having respective different RF signal frequency ranges, and a power combiner coupled to said plurality of RF signal generators.

9. The system of claim 1 wherein said RF source is configured to sweep the RF power over a wideband operating frequency range.

10. The system of claim 1 wherein said RF source operates over a frequency range of 0.5 to 200 MHz.

11. A coaxial radio frequency (RF) separator for separating a hydrocarbon/water emulsion comprising:

a coaxial input section configured for coupling to an RF power source and comprising an inner input section conductor and an outer input section conductor surrounding said inner input section conductor;

a coaxial output section configured for coupling to an RF load and comprising an inner output section conductor and an outer output section conductor surrounding said inner output section conductor; and a coaxial separator section coupled in series between said coaxial input and output sections, said coaxial separator section comprising an inner separator section conductor and an outer separator section conductor surrounding said inner separator section conductor and defining a separating chamber therebetween;

said coaxial separator section having at least one inlet port to introduce the hydrocarbon/water emulsion to the separating chamber and at least one outlet port to remove separated water and hydrocarbon from the separating chamber after exposure to RF power.

12. The coaxial RF separator of claim 11 wherein said coaxial separator section comprises a pair of spaced end plates interchangeably supporting respective opposing ends of said inner separator conductor and defining opposing ends of the separating chamber.

13. The coaxial RF separator of claim 11 wherein said input coaxial section comprises a dielectric material between said inner input section conductor and said outer input section conductor; and wherein said output coaxial section comprises the dielectric material between said inner output section conductor and said outer output section conductor.

14. The coaxial RF separator of claim 11 wherein the at least one inlet port is defined in said outer separator section conductor; and wherein the at least one outlet port is defined in said outer separator section conductor.

15. A coaxial radio frequency (RF) hydrocarbon treatment device comprising:

a coaxial input section configured for coupling to an RF power source and comprising an inner input section conductor and an outer input section conductor surrounding said inner input section conductor;

a coaxial output section configured for coupling to an RF load and comprising an inner output section conductor and an outer output section conductor surrounding said inner output section conductor; and a coaxial treatment section coupled in series between said coaxial input and output sections, said coaxial treatment section comprising an inner treatment section conductor and an outer treatment section conductor surrounding said inner treatment section conductor and defining a treatment chamber therebetween;

said coaxial treatment section having at least one inlet port to introduce a hydrocarbon to the treatment chamber and at least one outlet port to remove treated hydrocarbon from the treatment chamber after exposure to RF power.

16. The device of claim 15 wherein said coaxial treatment section comprises a pair of spaced end dielectric plates interchangeably supporting respective opposing ends of said inner treatment section conductor and defining opposing ends of the treatment chamber.

17. The device of claim 15 wherein said input coaxial section comprises a dielectric material between said inner input section conductor and said outer input section conductor; and wherein said output coaxial section comprises the dielectric material between said inner output section conductor and said outer output section conductor.

18. The device of claim 15 wherein the at least one inlet port is defined in said outer treatment section conductor; and wherein the at least one outlet port is defined in said outer treatment section conductor.

19. A method for separating a hydrocarbon/water emulsion comprising:

introducing a hydrocarbon/water emulsion into a coaxial separator section of a coaxial RF emulsion separator coupled in series between a coaxial input section and a coaxial output section, the coaxial separator section comprising an inner separator section conductor and an outer separator section conductor surrounding the inner separator section conductor and defining a separating chamber therebetween, and the coaxial separator section having at least one inlet port to introduce the hydrocarbon/water emulsion to the separating chamber;

supplying radio frequency (RF) power to the coaxial input section of the coaxial RF emulsion separator, the coaxial input section comprising an inner input section conductor and an outer input section conductor surrounding the inner input section conductor, and the coaxial output section comprising an inner output section conductor and an outer output section conductor surrounding the inner output section conductor; and removing separated water and hydrocarbon from the separating chamber via at least one outlet port of the coaxial separator section after exposure to RF power.

20. The method of claim 19 wherein the coaxial separator section comprises a pair of spaced end plates interchangeably supporting respective opposing ends of the inner separator conductor and defining opposing ends of the separating chamber.

21. The method of claim 19 wherein the input coaxial section comprises a dielectric material between the inner input section conductor and the outer input section conductor; and wherein the output coaxial section comprises the dielectric material between the inner output section conductor and the outer output section conductor.

22. The method of claim 19 wherein the at least one inlet port is defined in the outer separator section conductor; and wherein the at least one outlet port is defined in the outer separator section conductor.

23. The method of claim 19 further comprising controlling the flow of hydrocarbon/water emulsion introduced into the separating chamber using a flow controller to perform at least one of batch separating and continuous separating.

24. The method of claim 19 wherein the RF source comprises a plurality of RF signal generators having respective different RF signal frequency ranges, and a power combiner coupled to the plurality of RF signal generators.

25. The method of claim 19 wherein exposing comprises sweeping the RF power over a wideband operating frequency range.

26. The method of claim 19 further comprising coupling an RF load to the coaxial output section of the coaxial RF emulsion separator.

* * * * *